US007409809B1

(12) United States Patent
Degen et al.

(10) Patent No.: US 7,409,809 B1
(45) Date of Patent: Aug. 12, 2008

(54) AUTOMATIC TEST TUBE DECAPPING DEVICE

(76) Inventors: Lars Degen, Ballstav.187, Bromma (SE) 16859; Reda Iskarous, 125 S. 7th St., Wood River, IL (US) 62095

( * ) Notice: Subject to any disclaimer, the term of this patent is extended or adjusted under 35 U.S.C. 154(b) by 0 days.

(21) Appl. No.: 11/784,753

(22) Filed: Apr. 10, 2007

(51) Int. Cl.
*B65B 43/26* (2006.01)
*B67B 7/02* (2006.01)

(52) U.S. Cl. ..... 53/381.4; 81/3.2

(58) Field of Classification Search ..... 53/381.4, 53/492, 3.2, 3.27, 3.36, 3.37, 3.39, 3.4, 3.44, 53/3.48, 3.49, 3.55
See application file for complete search history.

(56) References Cited

U.S. PATENT DOCUMENTS 4,217,798 A * 8/1980 McCarthy et al. ..... 81/3.2
4,773,285 A * 9/1988 Dionne ..... 81/3.2
4,869,133 A 9/1989 Irazoqui
4,982,553 A * 1/1991 Itoh ..... 53/381.4
5,080,864 A * 1/1992 Shaw ..... 422/62
5,340,544 A * 8/1994 Nishikawa et al. ..... 81/3.2
5,481,946 A * 1/1996 Nishikawa et al. ..... 81/3.2
5,490,321 A * 2/1996 Kaneko ..... 29/714
6,257,091 B1 7/2001 Cohen
6,604,903 B2 8/2003 Osborne
6,871,566 B2 * 3/2005 Niwayama et al. ..... 81/3.2
7,152,504 B2 * 12/2006 Itoh ..... 81/3.2

* cited by examiner

*Primary Examiner*—Louis K Huynh
(74) *Attorney, Agent, or Firm*—Don W. Weber

(57) ABSTRACT

An automatic decapping device for test tubes is capable of decapping 20 or more test tubes pre-loaded onto a round carousel. A small motor drives three offset cams. The first offset cam pushes a decap/eject arm over the cap of a tube. The cam and associated drive arms and brackets move a needle down and into the cap. The decap arm and needle are then raised and pull the cap upward and back, removing the cap. An ejection lever then removes the cap from the needle and the cap is fed down a disposal chute. A second offset cam simultaneously moves a support arm onto the lower part of the vertical tube to support the tube as the decapping occurs. As the decap/eject and support arms return to their home positions a third offset cam drives the carousel to position the next tube in front of the decap/eject and support arms and the cycle begins again. A one-way spring ratchet positioning mechanism allows for the incremental positioning of each tube in proper position for each decapping cycle. An internal switch turns the device off when all tubes have been decapped.

5 Claims, 6 Drawing Sheets

AUTOMATIC TEST TUBE DECAPPING DEVICE

BACKGROUND OF THE DEVICE

This Invention relates to the field of medical testing. More particularly, an automatic decapping device for a capped test tube, commonly known as a vacutainer, is presented.

In the medical testing field, blood tests and other fluid tests are common. Blood is normally drawn by the insertion of a needle into the subject's arm. Blood is then drawn into a container, usually in the shape of a test tube. A test tube has a generally cylindrical shape and is rounded at the bottom. A rubber or plastic cap at the top usually seals the top of the test tube. In the vacutainer field, the caps are either removable by prying (flexible stoppers) or by twisting (threaded stoppers). The test tubes, commonly known as vacutainers, are then taken or shipped to a laboratory.

Once at the lab site the top cap must be removed. Often labs deal with large quantities of vacutainers at one time. To handle these vacutainers a technician loads the tubes vertically into a cylindrical carousel. The carousel can carry a large number of vacutainers. Due to the presence of diseases, the decapping procedure presents a certain amount of risk to the lab technician. Blood spills, drips or other leakages can cause serious illness for the human handler. It is an object of this invention to provide an automatic decapping machine that removes caps from test tubes without the need for human intervention in the decapping process.

Various methods of opening removable flexible capped vacutainers have been devised. For example, the 2003 patent issued to Osbourne (U.S. Pat. No. 6,604,903) describes an automated device used to remove the flexible cap from a safety vial. Osbourne uses a pivotal member 430 to engage the lip of the safety vial. The vial is decapped in an inverted position as shown in Osbourne. The bottle in Osbourne is pulled upwards (Column 9, lines 5-7) and the cap is pried off the bottle. Osbourne is of interest in this field because it shows a prying mechanism for removal of a flexible cap. However, it does not allow for the removal of a number of caps loaded onto a carousel in an upright position or for a method of disposal of the caps. It is another object of this invention to provide an automatic decapping device for vacutainers that is capable of decapping a quantity of containers loaded upright onto a carousel in one systematic function.

Another prying tool for removal of top caps of a test tube is disclosed in the 1989 patent issued to Irazoqui (U.S. Pat. No. 4,869,133). The Irazoqui device is hand held and designed to remove one cap at a time by prying and lifting the cap from the vacutainer. It a still further object of this invention to provide a desktop automatic decapping machine capable of removing multiple caps from vacutainers loaded onto a carousel.

Several desktop decapping machines for vacutainers have been described previously in the literature. The 2001 patent issued to Cohen (U.S. Pat. No. 6,257,091) and the 2006 patent issued to Itoh (U.S. Pat. No. 7,152,504) are examples of this type of decapping machine. Both Cohen and Itoh disclose integrated mechanisms capable of removing caps from test tubes. Itoh has a clamping mechanism, a movable frame and a chucking mechanism. The chucking mechanism grips and rotates the cap. The Cohen mechanism also grips the cap with upper grippers and rotates the test tube with lower grippers. The gripping and rotating mechanisms of Itoh and Cohen are valuable resources for removal of threaded caps. However, since the necessarily involve twisting the vacutainer, they have the drawback that they are not useful in decapping a large quantity of caps from test tubes loaded onto a carousel.

It is yet another object of this invention to provide an automatic decapping machine for decapping flexible caps from a large quantity of test tubes.

Other and further objects of this invention will become obvious upon reading the below described specification.

BRIEF DESCRIPTION OF THE DEVICE

The decapper of this invention is an automated bench top device that accepts a carousel loaded with flexibly capped upright test tubes. An electric motor turns three nonconcentric cams simultaneously. A first cam pushes a decap/eject arm forward and over a capped tube. As the push arm moves backwards a decapping needle grips the cap. The decap/eject arm moves simultaneously backwards and upwards to decap the vacutainer. The cap is then dropped into a disposal chute for sanitary disposal.

As the decapping motion is taking place, a second cam drives a support arm against the body of the vacutainer to support the test tube as the prying motion is accomplished. The support arm is withdrawn once the decapping procedure is finished.

A third cam drives the cylindrical carousel loaded with a quantity of vacutainers. As the decapping and support motion is completed, the third cam moves the carousel in a circular motion. A one-way ratchet positioning mechanism incrementally moves the carousel to present the next test tube to the decapping and support mechanism. The process is then repeated.

BRIEF DESCRIPTION OF THE DRAWING FIGURES

DETAILED DESCRIPTION OF THE PREFERRED EMBODIMENT

Figure 1:
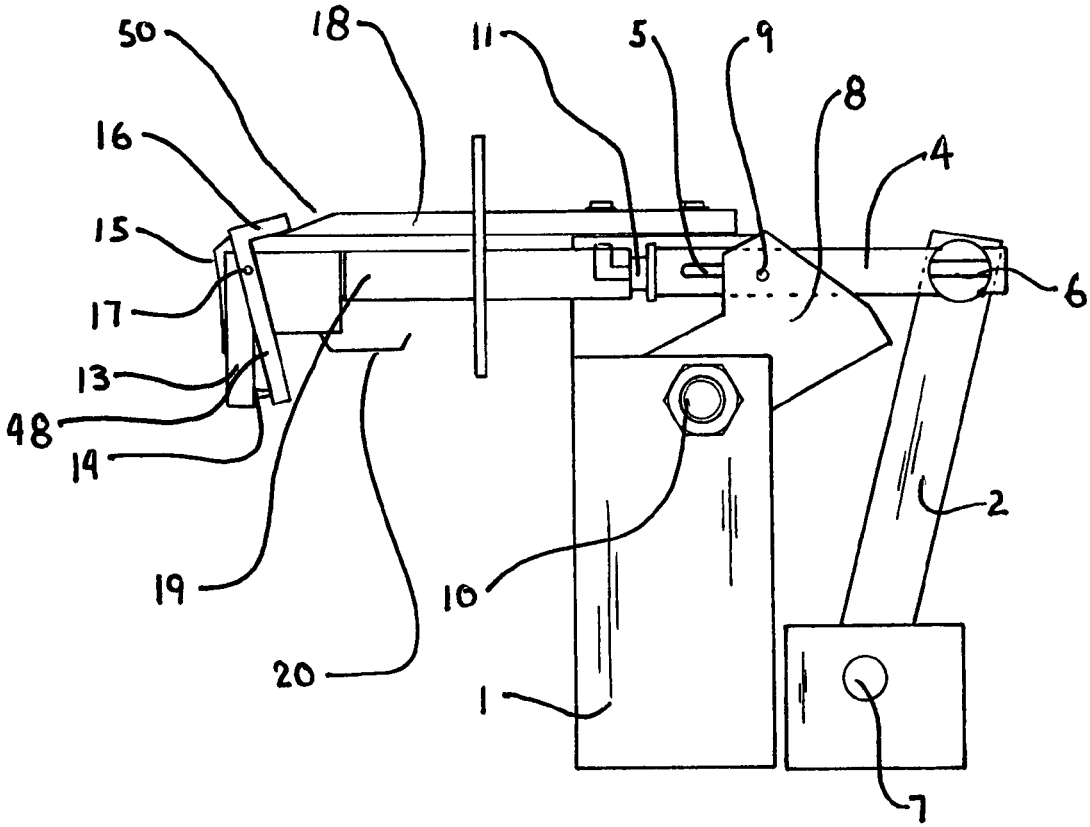
FIG. 1 is a partial right side view of the device showing in particular the drive mechanism for the decapping arm.

The automatic bench top-decapping machine has three nonconcentric cams driven by a single electrical motor. As best shown in FIG. 1, a support bracket 1 is fixedly attached to the base of the device. A decap/eject push arm 2 is pivotably attached to the base at lower pivot point 7. A tension spring 3 (shown on FIG. 2) biases the push arm 2 in the forward direction. In the drawings the "forward direction" is towards the front of the device (the left side of drawing FIG. 1, the right side of drawing FIG. 2).

Pivotally attached to the decap/eject push arm 2 is a horizontal slotted drive arm 4. This drive arm 4 has a horizontal slot 5 as shown in FIG. 1. The push arm 2 and drive arm 4 have a first end pivotably connected at pivot point 6. The decap/eject push arm 2 is thus pivotably connected at both ends to the base of the device and to the drive arm as shown.

Figure 6:
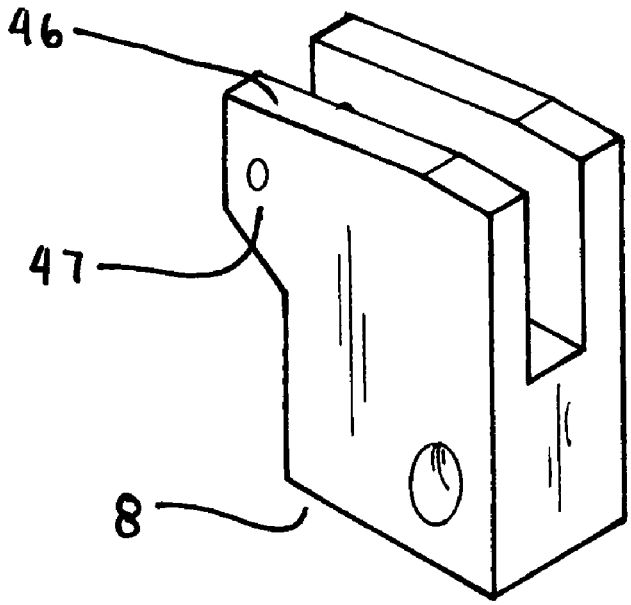
FIG. 6 is a perspective view of the irregularly shaped black decap/eject positioning bracket.
Figure 7:
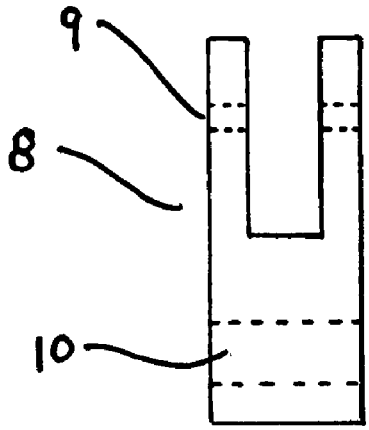
FIG. 7 is a rear end view of the decap/eject bracket.
Figure 8:
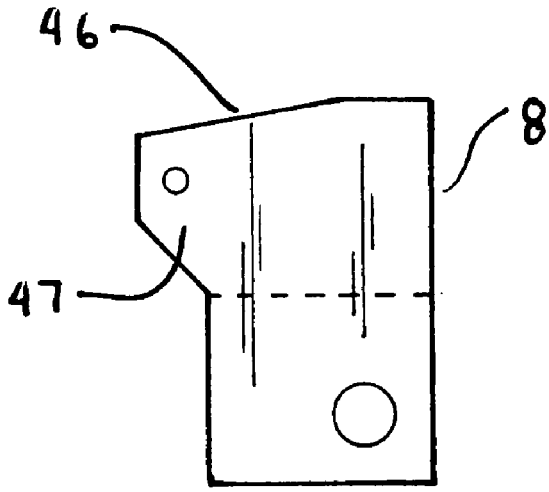
FIG. 8 is a side view of the decap/eject bracket.

A unique irregularly shaped decap/positioning black bracket 8 has a top part pivotably connected to the drive arm 4 at slot 5 by a pin. The lower part of positioning bracket 8 is pivotably connected to support bracket 1 at positioning bracket lower pivot point 10. The unique shape of the decap/positioning bracket 8 is best shown on FIGS. 6, 7, and 8. This irregular shape is best described as a rectangle having a downwardly and frontwardly tapered top 46 and a front trapezoidal nose 47. The decap/positioning bracket 8 moves the decapping arm and needle in its unique prying motion to be described later.

Figures 2, 2A:
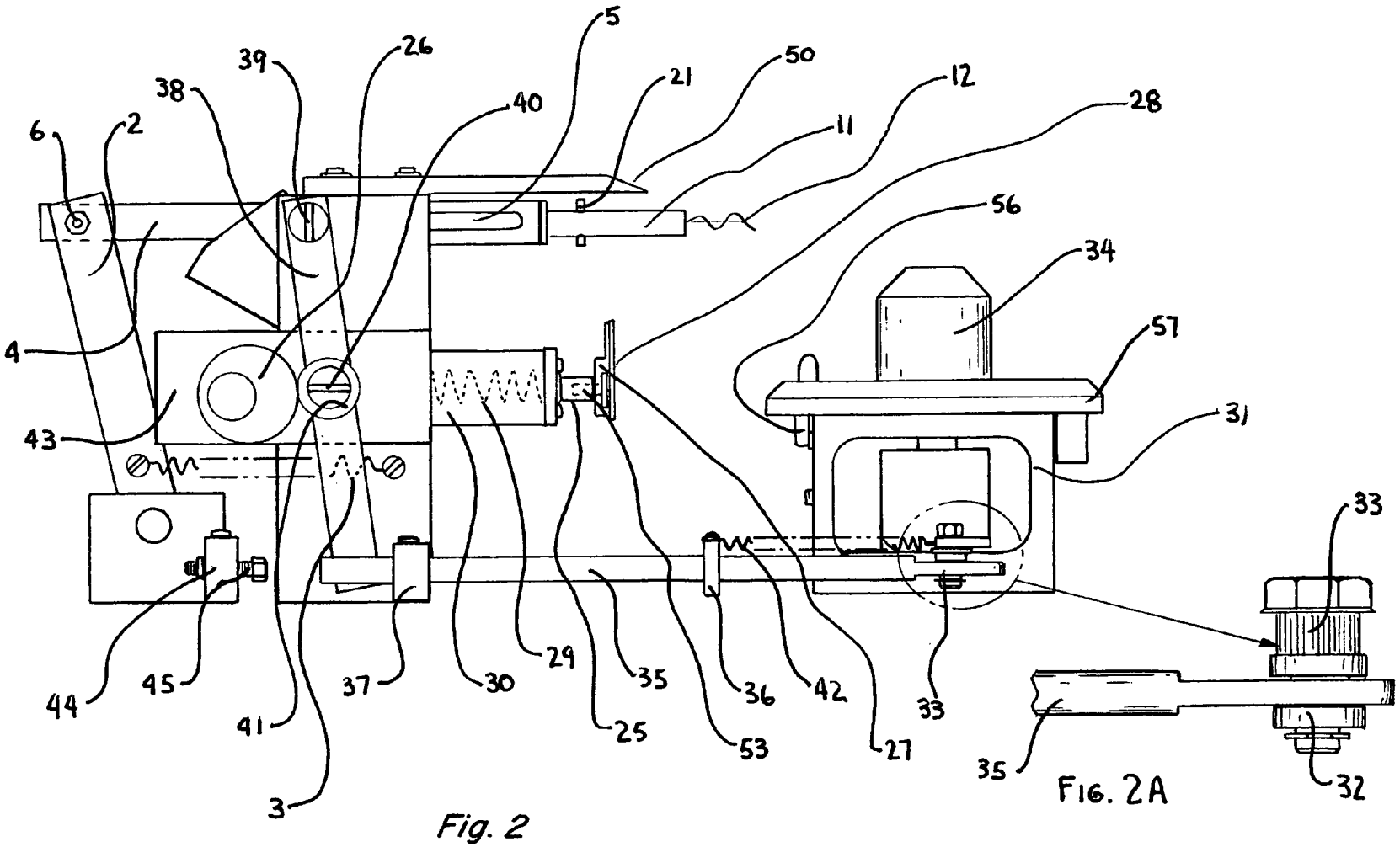
FIG. 2 is a left side view of the device particularly showing the carousel drive mechanism.
FIG. 2A is a detail-enlarged view of the carousel drive attachment.

Returning to FIGS. 1 and 2, the front decapping arm is shown. A decapping arm 11 is in contact with compression spring 12 (FIG. 2). The decapping arm 11 has one end connected to the slotted drive arm 4. Decapping arm barrel 19 is slidably located around and outside decapping arm 11. Spring 12 is located between decap arm 11 and decap barrel 19.

The front of decapping arm barrel 19 is attached to broad L-shaped holder 13. Arm barrel 19 and holder 13 slide horizontally along decapping arm 11 when the decapping/eject motion is in progress.

At the bottom of L-shaped holder 13 is a decapping needle 14. This needle 14 is inserted into the flexible (usually rubber or plastic) cap of the vacutainer during the decapping process. A puller lever leaf spring 15 is attached to the front of holder 13 and biases the top leg 49 of the puller lever 16 towards the rear of the device normally. This positions the bottom hole of the bottom leg 48 against the needle 14 normally.

A narrow L-shaped puller lever 16 is pivotably attached to the broad L-shaped holder 13 at pivot point 17. The bottom of the lower leg 48 of the puller lever 16 has a hole therein to receive the decapping needle 14. When the device is ready to puncture the cap of the vacutainer to begin the prying motion, the tip of needle 14 protrudes outwardly from the bottom of the lower leg 48 of puller lever 16.

A flat, tapered cap-removing piece 18 is fixedly attached to the top of support bracket 1. This cap-removing piece has a front taper as shown. This tapered piece 18 is located such that the upper leg 49 of puller lever 16 slides onto the taper 50 of piece 18 once the cap has been punctured and pried off the vacutainer in the decapping movement. The taper 50 causes the bottom leg 48 of puller lever 16 to rotate in a counterclockwise direction (shown on FIG. 1). This rotation pulls the cap from the needle. The cap is then disposed into a disposal chute 51 (shown in dashed lines in FIG. 3).

A stop spring 20 is attached to front holder 13. This spring 13 is designed to detect the cap and allows the decap arm to be positioned on the cap for proper insertion position. The top of the cap of the vacutainer rides on the bottom of cap spring 20. Due to this positioning of the cap by cap spring 20, the needle 14 will always puncture the cap at a vertical distance measured between the bottom of spring 20 and the rotated puncture position of needle 15.

Pin 21 serves as a quick attach/locking mechanism for the front decap/eject arm 19 when removing the decap/eject arm for cleaning purposes. Pin 21 may be quickly and easily removed to disconnect the decapping barrel 19 and holder 13 from the inner decapping arm 11.

Figure 1A:
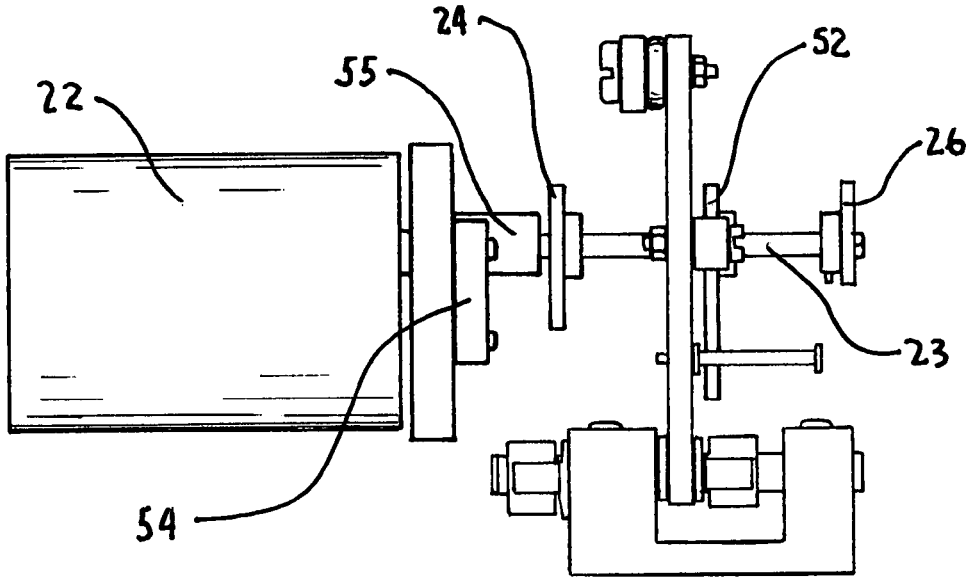
FIG. 1A is a rear end view of the device particularly showing the motor and the three cams.

Turning now to FIG. 1A, the electrical drive mechanism of the device is shown. An electric motor 22 is mounted onto the base of the device. The motor 22 has a horizontal shaft 23 that runs in a perpendicular direction from the horizontal slotted arm 4, decap arm 11 and barrel 19 as shown. A first decapper cam 52 is nonconcentric and offset from the motor shaft 23. Nonconcentric cam 52 is fixedly attached to the shaft 23. This first cam 52 moves the pull arm 2 from its forwardly biased direction rearwardly and then releases the pull arm to return to its biased forwardly position since cam 52 is offset. (The pull arm 2 is shown in its rearward position in FIG. 1.) When the pull arm 2 is in its rearward position as shown the puller lever 16 is in the eject mode as shown.

A second support arm cam 24 (FIG. 1A) is also fixedly attached to the shaft 23 as shown in FIG. 1A. The support arm cam 24 drives the support arm 25 (FIG. 2) to the forward position to support the lower part of the vacutainer body as the decapping prying action is completed.

A third carousel drive cam 26 is also adjustably connected to shaft 23. The carousel drive cam 26 may be rotated about the axis of shaft 23 for adjustment and then secured. This adjustment to cam 26 allows the user of the device to synchronize and properly position the three cams so that the decapping, support and rotation of the carousel and test tubes are all done simultaneously and in proper position.

The three cams are all offset nonconcentric cams, that is, they move the respective pull arm 2, support arm 38 and carousel drive arm 35 forward and backward to achieve the desired mechanical movements as described below.

The support arm 25 has a vertical shoe 27 fixedly attached at its outer, front end. On the front of this vertical shoe 27 is a rubber pad 28 covering the outer vertical surface. This rubber pad is adapted to come into contact with the lower vertical body of the test tube during the decapping procedure to support the vacutainer as pressure is applied to the top of the container in the prying action of the decapper. It is important that the decapping and the support are simultaneous in order to support the vacutainer as forces are applied to the top cap. The support arm 25 is spring loaded by spring 29 to sensitize and cushion the support of the rubber surface 28 on the lower body of the vacutainer. A screw 53 holds the support arm 25 to the vertical shoe 27. The support arm 25 and spring 29 are all contained within a white plastic barrel 30 as shown in FIG. 2.

The carousel turning and positioning mechanism is illustrated in FIG. 2. Test tubes or vacutainers may be loaded in the device carousel (not shown) in the capped and safe mode. A typical carousel may contain as many as 20 or more upright unopened vacutainers. The carousel is cylindrical and has upper, middle and lower support levels. Each respective support level has a concentric hole in it to receive the vacutainer.

The lower carousel housing 31 is shown in FIG. 2. The center of the carousel housing has a vertical cylindrical longitudinal shaft. The carousel housing longitudinal shaft is connected to the carousel hub 34 of the instant device. The carousel loaded with test tubes is placed over the carousel hub 34 and on carousel positioning plate 57 for use.

A carousel-connecting arm 32 is connected to the lower carousel housing 31. Carousel pivot shaft 33 connects the carousel-connecting arm 32 and the carousel feeder arm 35. The feeder arm 35 moves in a linear direction, left to right, to advance the carousel. This linear motion is translated to a circular motion for the carousel because the carousel-connecting arm 32 is located on the outer circumference of the carousel.

The carousel feeder arm 35 is located at the bottom of the device as shown. Front 36 and rear 37 guide blocks support the feeder arm 35. The front end of the feeder arm is rotatably connected to the carousel. The rear end of the feeder arm is pivotably connected to a carousel drive arm 38.

The top of the carousel drive arm 38 is pivotably connected to a brass rod spacer at carousel drive arm pivot point 39. Near the midpoint 40 of the carousel drive arm 38 is a rotatable nylon wheel 41. This nylon wheel 41 is in contact with third carousel cam 26. The cam is offset as shown to produce the nonconcentric cam effect described above.

A biasing compression spring 42 is connected between the carousel-connecting arm 32 and the front feeder arm guide bracket 36. This spring 42 biases the carousel feeder arm 35 to its rest position (to the left in FIG. 2). When the feeder arm 35 is in its rest position, it is waiting for the next cycle to place the next capped tube in position to be decapped. When third cam 26 rotates about the motor shaft axis to its forward position (the position shown in FIG. 2) the feeder arm 35 is pushed to the right to move the carousel incrementally one position.

A motor shaft bracket 43 secures the outer end of the motor shaft 23 in place. A rear end stop block 44 and adjusting screw 45 limits the distance the carousel feeder arm 35 may travel.

The carousel movement is a one-way ratcheted movement and only allows the carousel to travel an incremental set distance each cycle in the counter-clockwise direction (when the carousel is viewed from above looking front to back). When the carousel cam is in its extended position, as shown in FIG. 2, the carousel drive arm 38 is forced towards the front of the device. This, in turn, drives the carousel feeder arm 35 forward. This moves the carousel positioning plate 57, and vacutainers, one incremental ratchet position.

When carousel cam 26 turns on its axis of rotation such that the small part of the cam is next to the carousel drive arm, the drive arm 38 is pulled backwards towards the rear or rest position of the device (right to left on drawing FIG. 2) by spring 42. The combination of forces produced by the offset nonconcentric carousel cam 26 and the compression spring 42 produce the rotation of the carousel housing 31. Exact incremental positioning of the carousel is accomplished by the one-way ratchet mechanism.

Figure 3:
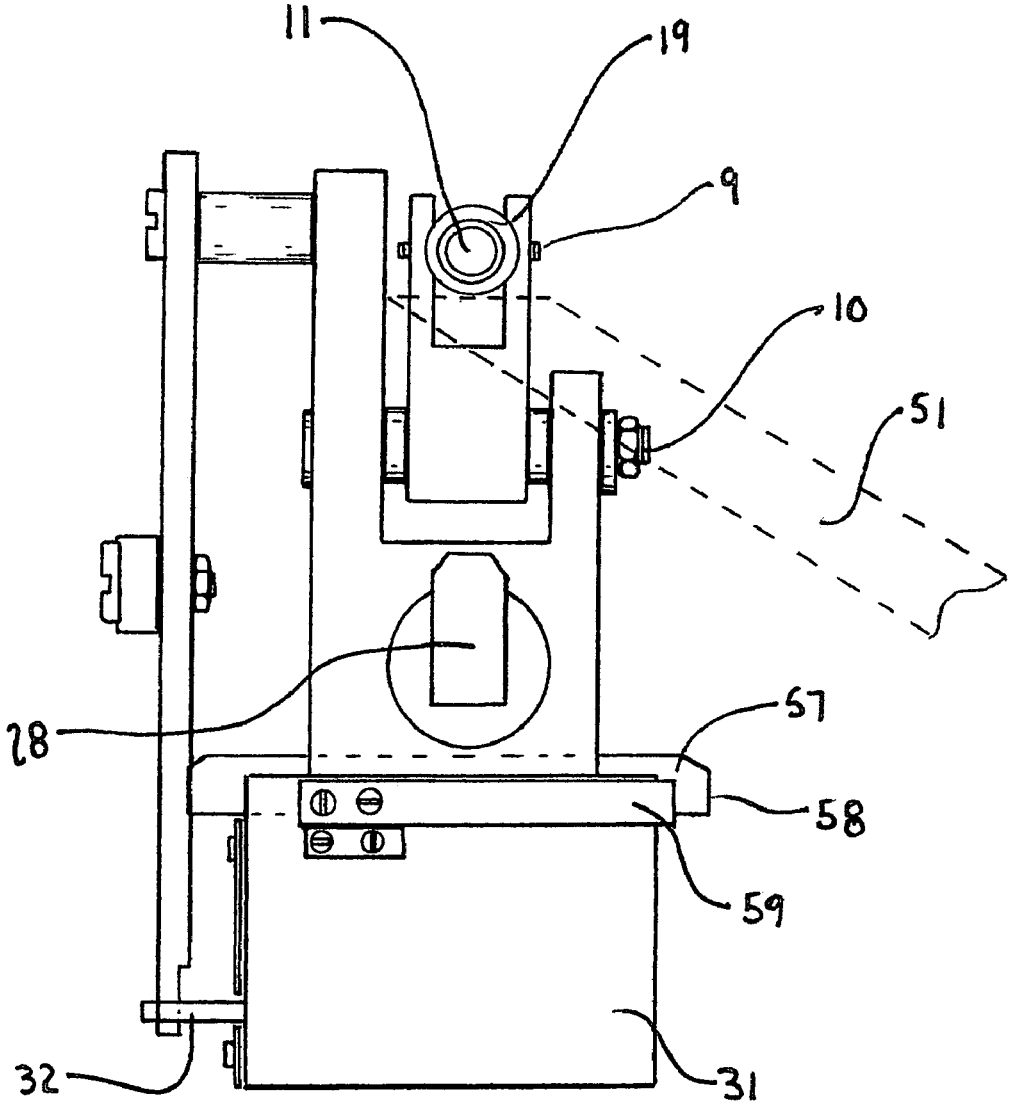
FIG. 3 is a front view of the device showing in particular the support arm and carousel ratchet positioning mechanism.
Figure 9:
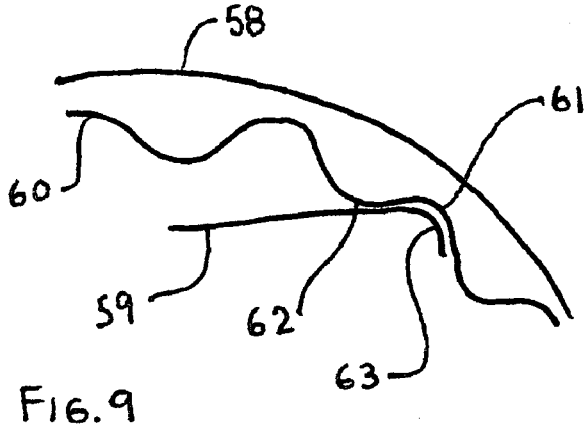
FIG. 9 is a partial view of the inner edge of the carousel positioning plate taken from below the top of the plate showing the positioning plate valleys and peaks and the positioning leaf spring.
Figure 4:
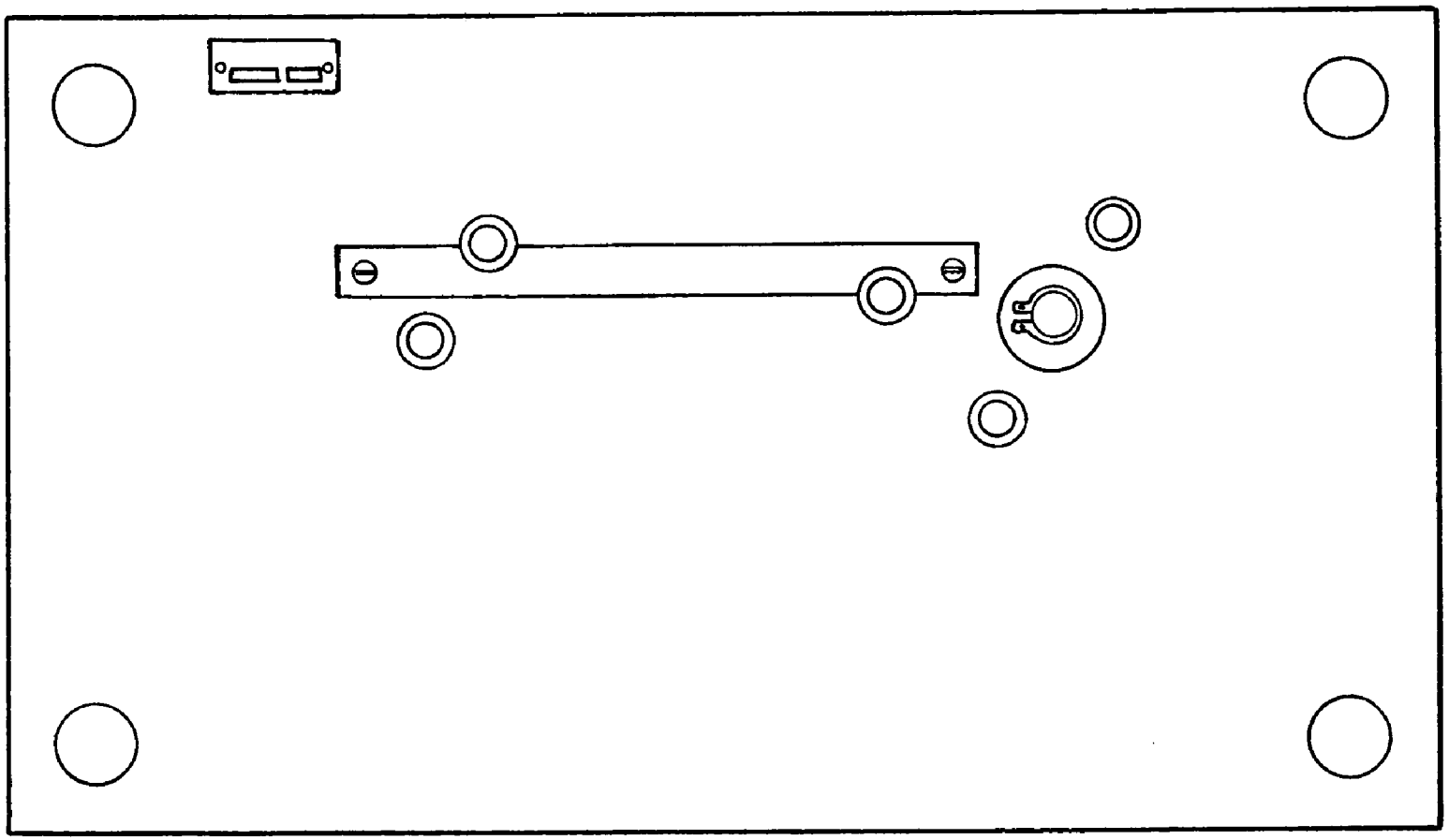
FIG. 4 is a bottom view of the device showing the bottom plate.

As best shown on FIGS. 3 and 9, the carousel (not shown) rides on carousel mounting plate 57. Circular carousel mounting plate 57 has a plurality of vertical incremental tube positioning valleys 61 and peaks 62 machined around its 360-degree inner circular circumferential edge 60. Each valley 61 allows for the incremental circular movement of the carousel plate one position for one tube or vacutainer.

A leaf positioning spring 59 is attached to the lower carousel housing 31 by screws. The leaf positioning spring 59 has a rounded outer end 63 corresponding to the shape of the incremental positioning valleys 61. The leaf spring 59 is biased inwards towards the center of carousel mounting plate 57. As the feeder arm 35 advances the carousel and carousel mounting plate 57 from a first valley position 61, the outer part of the leaf positioning spring 59 moves inwardly (towards the center of the carousel plate 57) from a first vertical positioning groove 61 and rides along a peak 62 of the carousel mounting plate 57. When the leaf spring 59 makes mechanical contact with the next carousel plate valley, the leaf spring 59 moves outwardly into that next valley and stops the motion of the mounting plate 57 at the next tube decapping position. The plurality of valleys 61 provide a corresponding plurality of corresponding incremental positions for a plurality of corresponding test tubes. The leaf positioning spring 59 and vertical incremental valleys 61 provide the incremental ratchet feature of the device.

FIG. 3 shows the front view of the device without the carousel loaded with vacutainers present. As the vacutainers are rotated to the proper position in front of the decapper arm 11 and rubber support pad 28, the mechanism lifts and pries off the cap automatically. Once that process is completed, the mechanism withdraws the decapper arm 11 and support pad 28 and rotates the carousel to position the next vacutainer in front of the decapper arm 11 and support pad 28. The process is repeated until all of the caps have been removed and disposed down the disposal chute.

Figure 5:
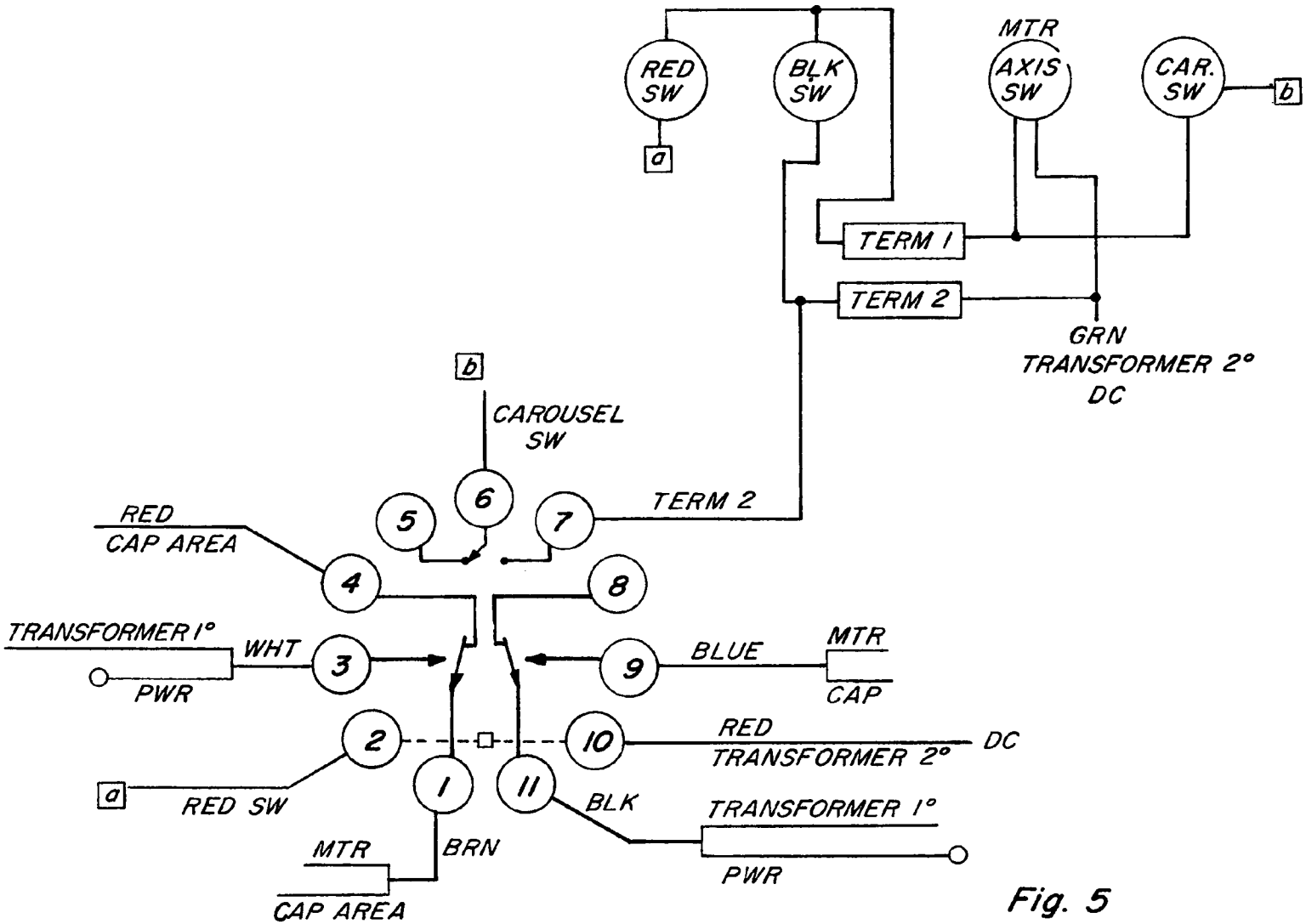
FIG. 5 is a block diagram of the electrical circuitry of the device.

The base of the device is shown in FIG. 5.

The electrical circuitry of the device is simple. It is illustrated in drawing FIG. 6. To start the decapper, an ON/OFF switch is provided. The electric circuitry also has an emergency STOP switch.

Two additional internal switches monitor the progression of the 360-degree rotation of the carousel. These internal switches automatically stop the machine at the home position once the carousel has rotated a full 360 degrees and operations are concluded. A first shaft switch 54 (FIG. 1A) is in mechanical contact with enlarged shaft hub 55. Shaft hub 55 has one valley machined into it at an appropriate point. Shaft switch 54 works cooperatively with carousel switch 56 (FIG. 2). Carousel switch 56 is in mechanical contact with lower carousel housing 31. Lower carousel housing 31 also has a valley machined into it. When shaft switch 54 is in mechanical contact with the valley on shaft hub 55 (the home position) and when carousel switch 56 is in mechanical contact with the valley on carousel housing 31 (the complete 360-degree rotation position) the entire device is shut off.

The motor operates on 110 or 220 volts AC at 50/60 Hz. The preferred motor is a one-amp motor generating 20 watts of power.

The device may be utilized to decap as many as 20 or more vacutainers during one process. The carousel feeder arm rotates the carousel so that the first vacutainer is positioned appropriately in front of the decapping/eject and support arms. The front-back horizontal motion of the carousel feeder arms translated into a rotational motion of the carousel. The second motion extends the tube support arm until it touches the lower part of the body of the vacutainer. This support arm supports the tube in its vertical position in preparation for the decap/eject arm to approach the tube cap.

The decap/eject arm is next driven forward over the capped tube. It is then lowered over the tube positioning itself to engage the cap. The decap/eject arm then starts to move backwards, engaging and puncturing the side of the cap and attaching itself to the cap. The decap/eject arm then moves backwards and upwards simultaneously to extract the cap from the tube. The tube support arm assists the extraction procedure by supporting the lower part of the tube and physically maintaining the tube in position. As the decap/eject arm continues to move backwards and upwards, the cap is completely extracted from the tube. The decap/eject arm continues to move backwards to its home position where the ejection mechanism ejects the cap from the point, allowing the cap to slide down the disposal chute.

As the decap/eject arm is moving back to its home position the tube support arm moves backwards to release the decapped tube and to its home position. Simultaneously, the carousel starts rotating to place the next tube in position to be decapped. The cycle repeats until all of the tubes in the carousel are decapped.

The decapper device also comes with an optional hinged cover for the carousel. The cover would be opened when the decapping process is taking place and could be closed when not in use.

The disclosure of the preferred embodiment herein is meant as an illustration only and not as a specific limitation unless set out in the claims. An important feature of the device is the upward and backward travel path of the decapping needle and the unique cap removal and disposal mechanism. It is important that all three of the main mechanism (decapping/removal, lower support of vacutainer and rotation of the carousel) are synchronized. The three offset cams accomplish this feature. It is preferred that the third feeder cam is adjustable so that the decapping/removal, support and carousel feeder occur in the same spatial relationship. Additionally, the one-way positioning ratchet mechanism and automatic electrical shut off switches provide added safety and usefulness to the device.

Other types of feeder systems may be used in practicing this invention. For example, a belt-feed or tray system for feeding pre-loaded test tubes can also be used with this invention. In that embodiment, the decap/eject and support mechanisms would remain the same. The modification would include a belt drive or tray system that could be synchronized using the third adjustable cam. The belt or tray would simply be incrementally moved by the action of the third drive cam.

We claim:

1. A device for automatically removing caps from a plurality of tubes, comprising:

(a) a motor having a shaft and having first, second and third offset cams attached to the shaft;

(b) a decapping arm barrel with an outer end having a decapping point, wherein said decapping point is driven over, down, into, up and back from a cap to be removed by the first offset cam; a pivotable bracket pivotably connected to said decapping arm barrel for enabling said over, down, into up and back motions of said decapping point;

(c) a support arm that moves forward to support the lower part of a tube when the decapping point is removing said cap, wherein said support arm is driven by the movement of the second offset cam;

(d) a feeder arm that moves a plurality of tubes in front of said decapping arm barrel and support arm wherein said feeder arm is driven by the third offset cam; wherein, said first, second and third cams operate together in a fixed relationship to synchronize the timing and positioning of each of said tubes.

2. A device for automatically removing caps from a plurality of tubes as in claim 1, wherein said tubes are loaded into an essentially cylindrical tube carousel and wherein said carousel is rotated an incremental distance each time said decapping arm barrel and said support arm are withdrawn.

3. A device for automatically removing caps from a plurality of tubes as in claim 2, wherein said carousel rides on a base having a plurality of inner incremental positioning valleys, further comprising a leaf positioning spring in mechanical contact with said incremental positioning valleys, whereby said carousel is moved incrementally one position each time said decapping arm barrel and said support arm mechanism are withdrawn.

4. A device for automatically removing caps from a plurality of tubes as in claim 1, wherein said tubes are pre-loaded into a belt and are moved a discreet incremental distance each time said decapping arm barrel and said support arm are withdrawn.

5. A device for automatically removing caps from a plurality of tubes as in claim 2, further providing automatic switches to stop said device once said carousel has rotated 360 degrees and decapped all tubes.

* * * * *